US011178915B2

(12) United States Patent
Parker

(10) Patent No.: US 11,178,915 B2
(45) **Date of Patent: *Nov. 23, 2021**

(54) SYSTEM AND AN APPARATUS FOR SWADDLE TRANSITION

(71) Applicant: Stephanie Parker, Fort Worth, TX (US)

(72) Inventor: Stephanie Parker, Fort Worth, TX (US)

( * ) Notice: Subject to any disclaimer, the term of this patent is extended or adjusted under 35 U.S.C. 154(b) by 222 days.

This patent is subject to a terminal disclaimer.

(21) Appl. No.: 15/638,560

(22) Filed: Jun. 30, 2017

(65) Prior Publication Data

US 2018/0168240 A1 Jun. 21, 2018

Related U.S. Application Data

(63) Continuation-in-part of application No. 13/447,177, filed on Apr. 14, 2012, now abandoned.

(51) Int. Cl.
*A41B 13/06* (2006.01)

(52) U.S. Cl.
CPC ..... *A41B 13/06* (2013.01)

(58) Field of Classification Search
CPC ... A41B 113/06; A41B 2300/00; A41B 13/06; A41B 13/065; A41B 2400/00; A41B 2400/38; A41B 24/00
USPC ..... 2/69.5
See application file for complete search history.

(56) References Cited

U.S. PATENT DOCUMENTS 2,562,061 A * 7/1951 Peterson ..... A41B 13/06 2/69.5
2,622,248 A * 12/1952 Schaye ..... A41B 13/005 2/80
D380,589 S * 7/1997 Westman ..... D2/719
5,722,094 A * 3/1998 Ruefer ..... A41B 13/06 2/69
6,662,390 B1 * 12/2003 Berger ..... A41B 13/06 2/69

* cited by examiner

*Primary Examiner* — Alissa J Tompkins
*Assistant Examiner* — Catherine M Ferreira

(57) ABSTRACT

A swaddle transition device is provided. The device may include a transition wrap that has one or more fabric layers. The device may also include one or more sleeves to cover the limbs of a baby wearing the transition wrap. Further, the device may include a fastener unit to open the transition wrap. The transition wrap has a design configuration to limit the startle reflex movement of the baby.

10 Claims, 4 Drawing Sheets

SYSTEM AND AN APPARATUS FOR SWADDLE TRANSITION

CROSS-REFERENCES TO RELATED APPLICATIONS

The present application is a continuation in part of pending U.S. patent application entitled, "System and Method for Transitioning an Infant from Swaddling," Ser. No. 13/447,177, filed on Apr. 14, 2012, which is hereby incorporated by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

FIELD OF THE TECHNOLOGY

The present disclosure generally relates to the field of articles of clothing and, more specifically, to an apparatus and a system for covering a baby with a swaddling blanket.

DESCRIPTION OF THE RELATED ART

Swaddling is a practice of wrapping an infant in a cloth or a blanket to tightly restrict limb movements and create a womb-like environment Infants are often afflicted with the 'Moro' or startle reflex—where a baby's limbs startle or jerk spasmodically preventing a baby from getting sound sleep. Swaddling helps sooth irritable infants and assist babies to sleep longer. As a baby becomes more active, able to roll over, and able to break free from the swaddle wrap, transition from swaddling can start.

Transitioning an infant from being swaddled can be a difficult and tiring task, as it involves sleepless nights for both the parents and the child. Although the baby needs the mobility to push up and roll over at this point, the Moro reflex still prevents the infant from getting the sound sleep they need. This is sleep that is conducive and vital to proper development and growth. In addition, an infant who is accustomed to the enclosed and cozy sensation of the swaddle is met with the uneasy and uncomfortable freedom of having the swaddle suddenly removed. Hence, an infant may not be able to sleep for extended periods as he used to when swaddled.

Therefore, what is needed is an apparatus and a system for swaddling a baby that creates a womb-like environment and averts the startle reflex of a baby.

SUMMARY

In an embodiment, a swaddle transition device is provided. The device may include: a transition wrap having one or more fabric layers; one or more sleeves to cover the limbs of a baby wearing the transition wrap; and a fastener to open the transition wrap, wherein the transition wrap has a design configuration to limit the startle reflex movement of the baby.

In another embodiment, a swaddle transition apparatus is provided. The apparatus may include: a transition wrap having one or more fabric layers; one or more sleeves to cover the limbs of a baby wearing the transition wrap; and a fastener unit to open the transition wrap, wherein the transition wrap has a design configuration to limit the startle reflex movement of the baby.

In yet another embodiment, a swaddle transition system is provided. The system may include: a transition wrap having one or more fabric layers; one or more sleeves to cover the limbs of a baby wearing the transition wrap; and a fastener unit to open the transition wrap, wherein the transition wrap has a design configuration to limit the startle reflex movement of the baby.

BRIEF DESCRIPTION OF THE DRAWINGS

The present invention is described in detail below with reference to the attached drawing figures, which are incorporated by reference herein and wherein.

DETAILED DESCRIPTIONS

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent application, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent application (other than the language of the claims). To the extent that any term recited in the claims at the end of this patent application is referred to in this patent application in a manner consistent with a single meaning, that is done for sake of clarity only so as to not confuse the reader, and it is not intended that such claim term by limited, by implication or otherwise, to that single meaning Finally, unless a claim element is defined by reciting the word "means" and a function without the recital of any structure, it is not intended that the scope of any claim element be interpreted based on the application of 35 U.S.C. § 112, sixth paragraph.

Figure 1:
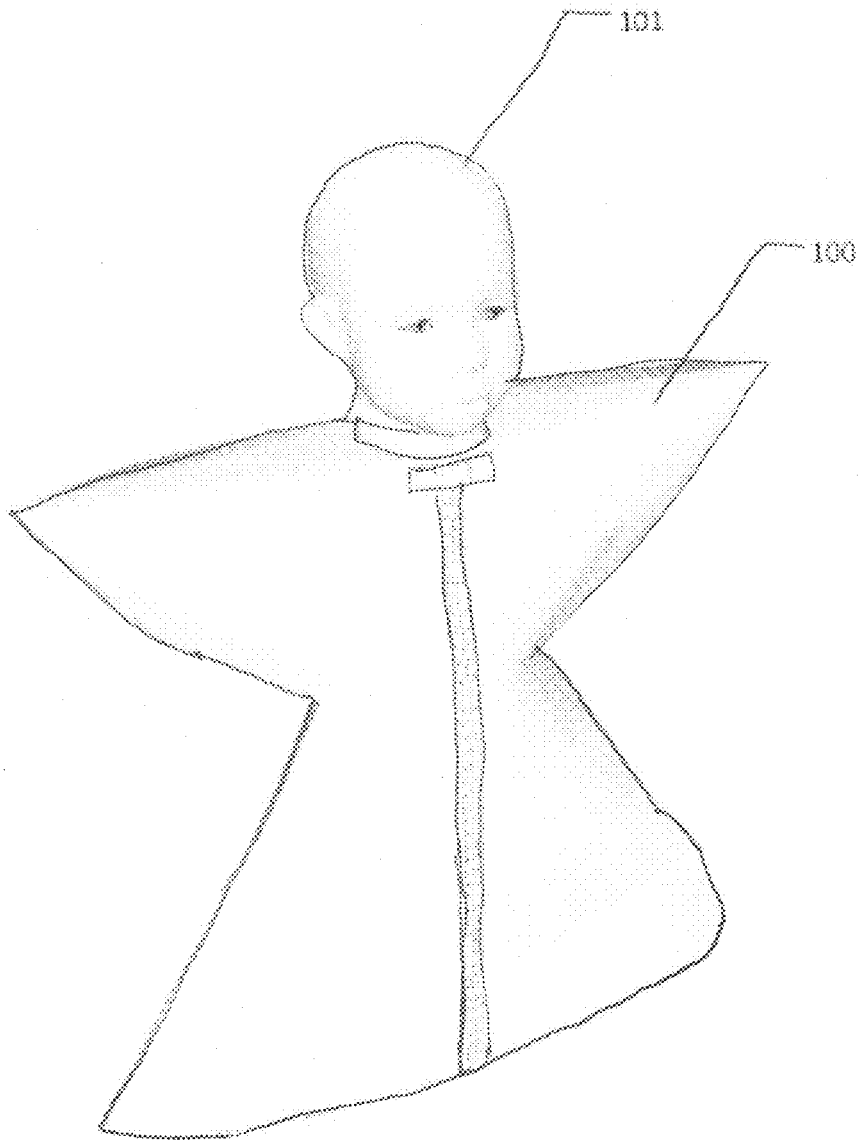
FIG. 1 is an infant covered in a transition wrap in accordance with an exemplary embodiment of the invention.

FIG. 1 illustrates an infant 101 covered in a transition wrap 100. Infant 101 can be covered with transition wrap 100, which can securely cover infant 101 arms, body, and legs. Transition wrap 100 can be designed to completely enclose infant 101 and at the same time can allow infant 101 movements with slight resistance.

Figure 2:
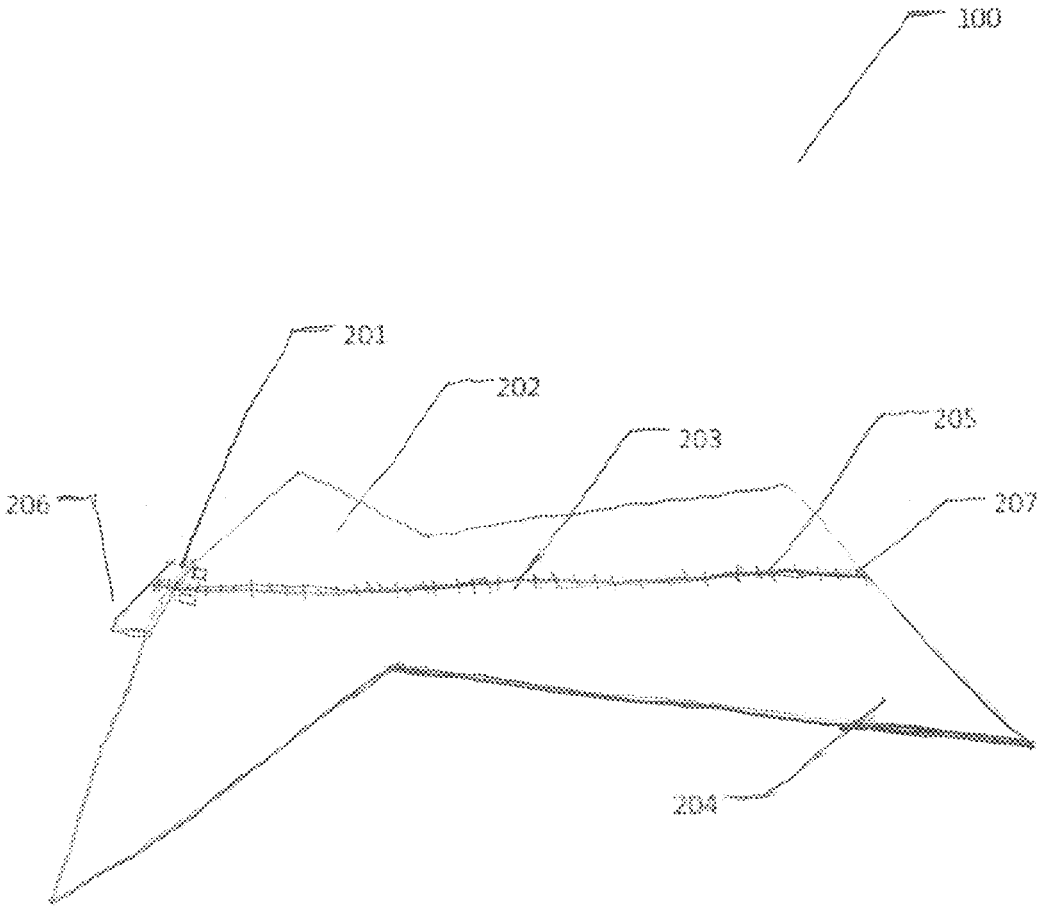
FIG. 2 is a transition wrap in accordance with an exemplary embodiment of the invention.

FIG. 2 illustrates a transition wrap 100. Transition wrap 100 can comprise a neck hole 201, arm sleeves 202, body 203, and leg cover 204. Neck hole 201 can serve as an opening that can allow the head of infant 101 to peek through. As such head of infant 101 can be outside enclosure of transition wrap 100. Further, neck hole 201 can have an extended portion forming a collar 206. Collar 206 can provide a soft and comfortable cushion around the neck of infant 101. Arm sleeves 202 can be full sleeves covering the arms of infant 101, or, alternatively, wherein arm sleeves 202 cannot contain any openings. Leg cover 204 can be an extended sheet covering the whole leg portion of infant 101. Further, leg cover 204 can be trapezoid in form, having a wider area at the bottom or feet area. As such, both legs of infant 101 can be wrapped and enclosed inside leg cover 204. In such shape, leg movements of infant 101, such as kicking can be restricted. Body 203 can be a portion that comprises neck hole 201 and connects arm sleeves 202 and leg cover 204 together. Further body 203 can have a middle portion or a slit 205 which can be a vertical cut that can split front portion of transition wrap 100 into two sides. Hence, slit 205 can give transition wrap 100 a wider opening. As such, with slit 205 an infant 101 can be easily slipped or clothed with transition wrap 100. In one embodiment, slit 205 can be positioned at the middle of transition wrap 100, extending from neck hole 201 down to as far as leg cover 204. In such embodiment, slit 205 can open transition wrap 100 in full. In another embodiment, slit 205 can extend from neck hole 201 and go a portion down transition wrap 100. In such embodiment, transition wrap 100 can only be halfway opened. Further, slit 205 can comprise fastener 207. Fastener 207 can be any type of fabric fastener such as a snap, a button, and/or a zipper, capable of joining two edges of slit 205 together.

Transition wrap 100 can be made from any soft material, which includes but is not limited to cotton, silk, chenille, and/or polyester fabrics. As such, transition wrap 100 can be used as a wearable blanket, which can be used as an alternative or replacement for traditional infant pajamas. Transition wrap 100 can be designed in varying shapes and sizes. In one embodiment, transition wrap 100 can have different thickness of fabric or padding. As such, transition wrap 100 can be designed to have several layers or varying thickness, depending on the weather condition. In another embodiment transition wrap 100 can be stuffed with materials capable of regulating desired condition, and in order to provide comfortable temperature to infant 101.

Figure 3:
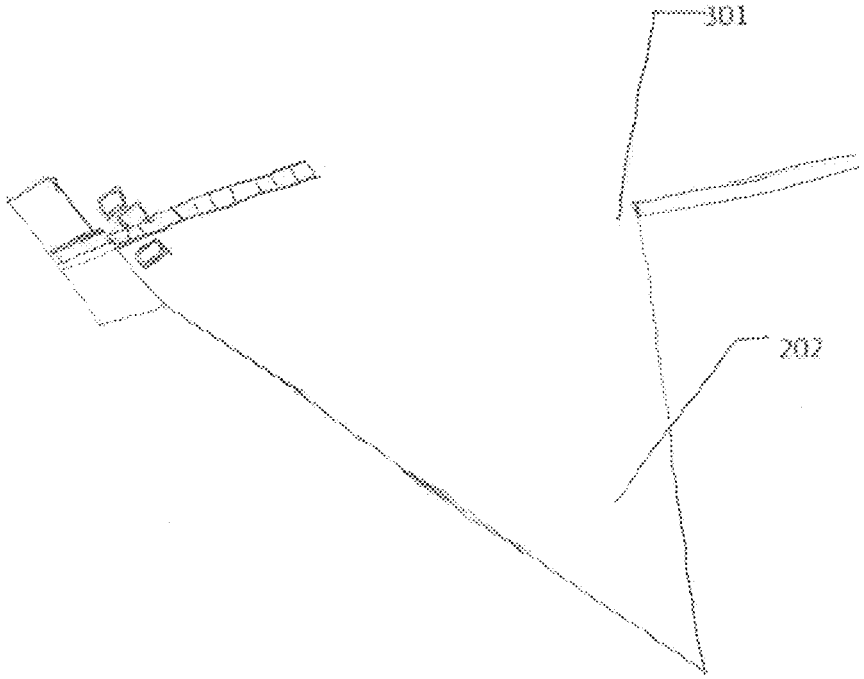
FIG. 3 illustrates the wing span of arm sleeves in accordance with an exemplary embodiment of the invention.

FIG. 3 illustrates wingspan 301 of arm sleeves 202. Arm sleeves 202 can be designed to have a wingspan 301, which can enable infant 101 to move his arms freely but with slight resistance. Wingspan 301 can be designed in an angular shape, where arms of infant 101 can be placed. In such embodiment, wingspan 301 can have a triangular form, creating an angle or a tip in arm sleeves 202. Wingspan 301 can then extend downward, narrowing at the portion where the body of infant 101 can be situated. Arm sleeves 202 can each be closed to prevent infant from moving his arms outside transition wrap 100.

Figure 4:
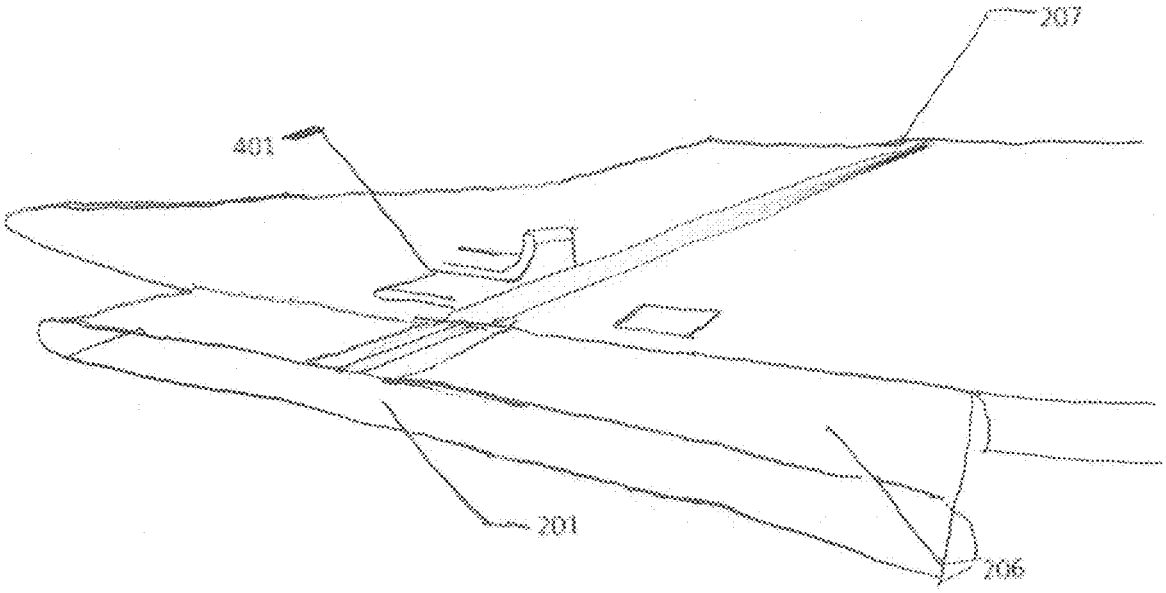
FIG. 4 is a cover flap for a zipper head in accordance with an exemplary embodiment of the invention.

FIG. 4 illustrates a cover flap 401. In an embodiment, the fastener 207 can be a zipper, or a cover flap 401 that can be used to cover a portion of fastener 207. Cover flap 401 can comprise of snap fastener that can include buttons, snap, or hook and loop fasteners. Further, cover flap 401 can be placed at the top stop of a zipper, wherein top stop of a zipper can be placed near neck hole 201 and just below collar 206. Top stop of a zipper can be the portion of a zipper where pull tab of a zipper can rest while on fastened or closed position. Hence, cover flap 401 can be used to safely hide or tuck sharp edges of a zipper. In another embodiment, cover flap 401 can cover the whole portion of fastener 207. In one embodiment, cover flap 401 can be an extended material covering full length of fastener 207.

In some implementations, the transition wrap 100 may be made of one or more of the following transition wrap materials: polyester, spandex, cotton, nylon, modacrylic, poly fleece, or any known material known by those skilled in the art. The transition wrap 100 may comprise a material composition in the range from 0% to 100% of any the one or more transition wrap materials. In some embodiments, the polyester may be lightweight. In an embodiment, the transition wrap 100 may have a material composition mixture of 96% polyester and 4% spandex. In another embodiment, the transition wrap 100 may have a material composition mixture of 50% cotton and 50% modacrylic.

In yet another embodiment, the transition wrap 100 may be implemented as one or more transition wraps. The transition wrap 100 may include one or more design configurations such as a star fish configuration, a turtle configuration, a mermaid configuration, a penguin configuration, or any design configuration known to those skilled in the art. In some embodiments, the star fish configuration may include one or more star shaped pointed sleeves.

In some embodiments, the transition wrap 100 may include one or more dimension components. The dimension components may include one or more measurements such as high point shoulder (HPS) to bottom hem, chest, shoulder length, underarm length, side seam length, across back (point to point), neck opening, neck binding width, sweep, zipper length, tolerance, or measurement known to those skilled in the art.

In another embodiment, the transition wrap 100 may have measurements for a high point shoulder (HPS) to bottom hem, a chest, a shoulder length, a underarm length, a side seam length, an across back (point to point), a neck opening, a neck binding width, a sweep, a zipper length, and tolerance, in the range of 0 inches to 100 inches, respectively.

In some embodiments, the high point shoulder (HPS) to bottom hem measurement, the chest measurement, the shoulder length measurement, the underarm length measurement, the side seam length measurement, the across back (point to point) measurement, the neck opening measurement, the neck binding width measurement, the sweep measurement, zipper length measurement, or the tolerance measurement in the range of between 25-40 inches, between 10-17 inches, between 10-17 inches, between 7-13 inches, between 12-25 inches, between 20-35 inches, between 8-13 inches, between 0.1-1 inches, between 18-25 inches, between 20-30 inches, and between 0.1 and 1 inches, respectively.

In still another embodiment, the transition wrap 100 may include a two way zipper. The two-way zipper (not shown) may be configured to open from the top and/or the bottom or any known orientation known by those skilled in the art.

In an embodiment, the transition wrap 101 may include one or more fabric layers to define a base layer of a blanket body from a proximal portion to a distal portion of the blanket body on which the body of the baby is configured to rest. In another embodiment, the fabric layers may disposed above another set of fabric layers and include a distal end attached to the distal portion of the fabric layers. In yet another embodiment, the fabric layers may include an inner surface and an outer surface and extending toward the proximal portion of the fabric layers. The fabric layers may include one or more pockets therebetween configured to receive the legs of the baby therein.

In still another embodiment, the transition wrap 100 can be made of a one or more portions of moisture wicking material or breathable mesh that facilitates maintaining the baby relatively cool while wrapped in the transition wrap by wicking away sweat from the baby. In one embodiment, the wicking material may include one or more mesh surfaces with one or more openings that allow flow of air for ventilation of the transition wrap 100. The wicking material may be fire retardant, and may have a high abrasion rating (i.e., high abrasion resistance) that inhibits snag and wear.

In yet another embodiment, the transition wrap 100 may include one or more storage compartments or one or more attachment locations to carry additional items. The compartments or attachment locations may have a rectangular, cylindrical, circular shape, or any shape known to those skilled in the art. The compartments or attachment locations may have the dimensions of height, length, width, depth, diameter, respectively, in the ranges of 0-100 inches.

Many different arrangements of the various components depicted, as well as components not shown, are possible without departing from the spirit and scope of the present invention. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A swaddle transition apparatus comprising:

a transition wrap having one or more fabric layers at least partially encasing a compartment configured to receive a body of a baby within the transition wrap;

the compartment formed via proximal and distal fabric layers, the proximal and distal fabric layers coupled to each other at a periphery of the compartment;

the compartment comprising a central body portion comprising a midline and a neck opening disposed at an upper extent of the body portion at said midline;

the compartment comprising a pair of triangular-shaped sleeves forming a portion of the compartment periphery at the upper extent and a extending laterally outward from the neck opening along a downward slope such that the upper extent terminates at respective sleeve lateral endpoints, wherein the compartment periphery extends inward at a downward slope toward said midline to terminate at a waist of said body portion such the periphery forms said triangular shaped sleeves to cover and encase respective arm limbs of the baby while disposed within the transition wrap, wherein the sleeve lateral endpoints each comprise a point forming an angle or tip between the outward downward slope and inward downward slope of the periphery;

the compartment comprising a singular leg portion extending laterally outward and downward from the waist to form a trapezoidal shape extending laterally outward toward a lower extent of the compartment periphery;

and a fastener unit in the proximal fabric layer of the transition wrap extending vertically downward along the proximal fabric layer so as to allow a user to open the transition wrap;

wherein the transition wrap as defined by the triangular shape of the sleeves and the trapezoidal shape of the leg portion in relation to the body portion, allow movement of the arm limbs and leg limbs of the baby, when positioned in the transition wrap, with slight resistance with respect to the transition wrap so as to limit a startle reflex movement of the baby.

2. The apparatus of claim 1, wherein a vertical distance between the lower extent and the neck opening at the midline is at least equal to a vertical distance between the lower extent and the neck opening at the lateral ends of the lower extent.

3. The apparatus of claim 1, wherein the apparatus is configured for size adjustment and wherein the size adjustment increases or decreases the size of the transition wrap.

4. The apparatus of claim 1, wherein the lateral ends of the singular leg portion form points at the lower extent.

5. The apparatus of claim 1, wherein the fastener unit comprises a zipper.

6. A swaddle transition system comprising:

a transition wrap having one or more fabric layers at least partially encasing a compartment configured to receive a body of a baby within the transition wrap;

the compartment formed via proximal and distal fabric layers, the proximal and distal fabric layers coupled to each other at a periphery of the compartment;

the compartment comprising a central body portion comprising a midline and a neck opening disposed at an upper extent of the body portion at said midline;

the compartment comprising a pair of triangular-shaped sleeves forming a portion of the compartment periphery at the upper extent and extending laterally outward from the neck opening along a downward slope such that the upper extent terminates at respective sleeve lateral endpoints, wherein the compartment periphery extends inward at a downward slope toward said midline to terminate at a waist of said body portion such that the periphery forms said triangular shaped sleeves to cover and encase respective arm limbs of the baby while disposed within the transition wrap;

the compartment comprising a singular leg portion extending laterally outward and downward from the waist to form a trapezoidal shape extending laterally outward toward at a lower extent of the compartment periphery, wherein the lateral ends of the singular leg portion form points at the lower extent;

and a fastener unit in the proximal fabric layer of the transition wrap extending vertically downward along the proximal fabric layer so as to allow a user to open the transition wrap;

wherein the transition wrap as defined by the triangular shape of the sleeves and the trapezoidal shape of the leg portion in relation to the body portion, allow movement of the arm limbs and leg limbs of the baby, when positioned in the transition wrap, with slight resistance with respect to the transition wrap so as to limit a startle reflex movement of the baby.

7. The system of claim 6, wherein the system includes moisture wicking material.

8. The system of claim 6, wherein a vertical distance between the lower extent and the neck opening at the midline is at least equal to a vertical distance between the lower extent and the neck opening at the lateral ends of the lower extent.

9. The system of claim 8, wherein the sleeve lateral endpoints each comprise a point forming an angle or tip between the outward downward slope and inward downward slope of the periphery.

10. The system of claim 6, wherein the fastener unit is a two-way zipper.

* * * * *